United States Patent [19]

Boyer et al.

[11] 4,418,752

[45] Dec. 6, 1983

[54] THERMAL OIL RECOVERY WITH SOLVENT RECIRCULATION

[75] Inventors: Lyndon D. Boyer; Ardis L. Anderson, both of Ponca City, Okla.; Michael W. Britton, Corpus Christi, Tex.

[73] Assignee: Conoco Inc., Ponca City, Okla.

[21] Appl. No.: 337,799

[22] Filed: Jan. 7, 1982

[51] Int. Cl.[3] ..... E21B 43/24; E21B 43/40

[52] U.S. Cl. ..... 166/267; 166/266; 166/272; 166/303

[58] Field of Search ..... 166/266, 267, 303, 272, 166/306

[56] References Cited

U.S. PATENT DOCUMENTS

| | | | |
|---|---|---|---|
| 2,412,765 | 12/1946 | Buddrus et al. | 166/266 |
| 2,725,106 | 11/1955 | Spearow | 166/268 |
| 3,116,231 | 12/1963 | Adee | 208/46 |
| 3,258,501 | 9/1970 | Parker | 166/266 |
| 4,033,412 | 7/1977 | Barrett | 166/267 |
| 4,133,384 | 1/1979 | Allen et al. | 166/272 |
| 4,160,479 | 7/1979 | Richardson et al. | 166/272 X |
| 4,160,814 | 7/1979 | Hardin et al. | 423/461 |
| 4,251,323 | 2/1981 | Smith | 201/29 |
| 4,265,310 | 5/1981 | Britton et al. | 166/272 X |
| 4,362,213 | 12/1982 | Tabor | 166/267 |

*Primary Examiner*—Stephen J. Novosad

*Attorney, Agent, or Firm*—Richard W. Collins

[57] ABSTRACT

A process for the production of heavy oil from a subterranean oil reservoir by the injection of a hot aqueous fluid into the reservoir and the injection of a diluent solvent down the production well to produce a blend of solvent and oil having a decreased viscosity. The reservoir oil has a density greater than the density of water. The diluent solvent has a density such that the density of the resulting blend recovered from the production well also has a density greater than the density of the water. The water produced from the production well is separated from the blend and the blend then fractionated to recover a solvent fraction of the requisite density. This solvent fraction is then returned to the production well to produce additional blend within the well in a continuation of the process.

10 Claims, 1 Drawing Figure

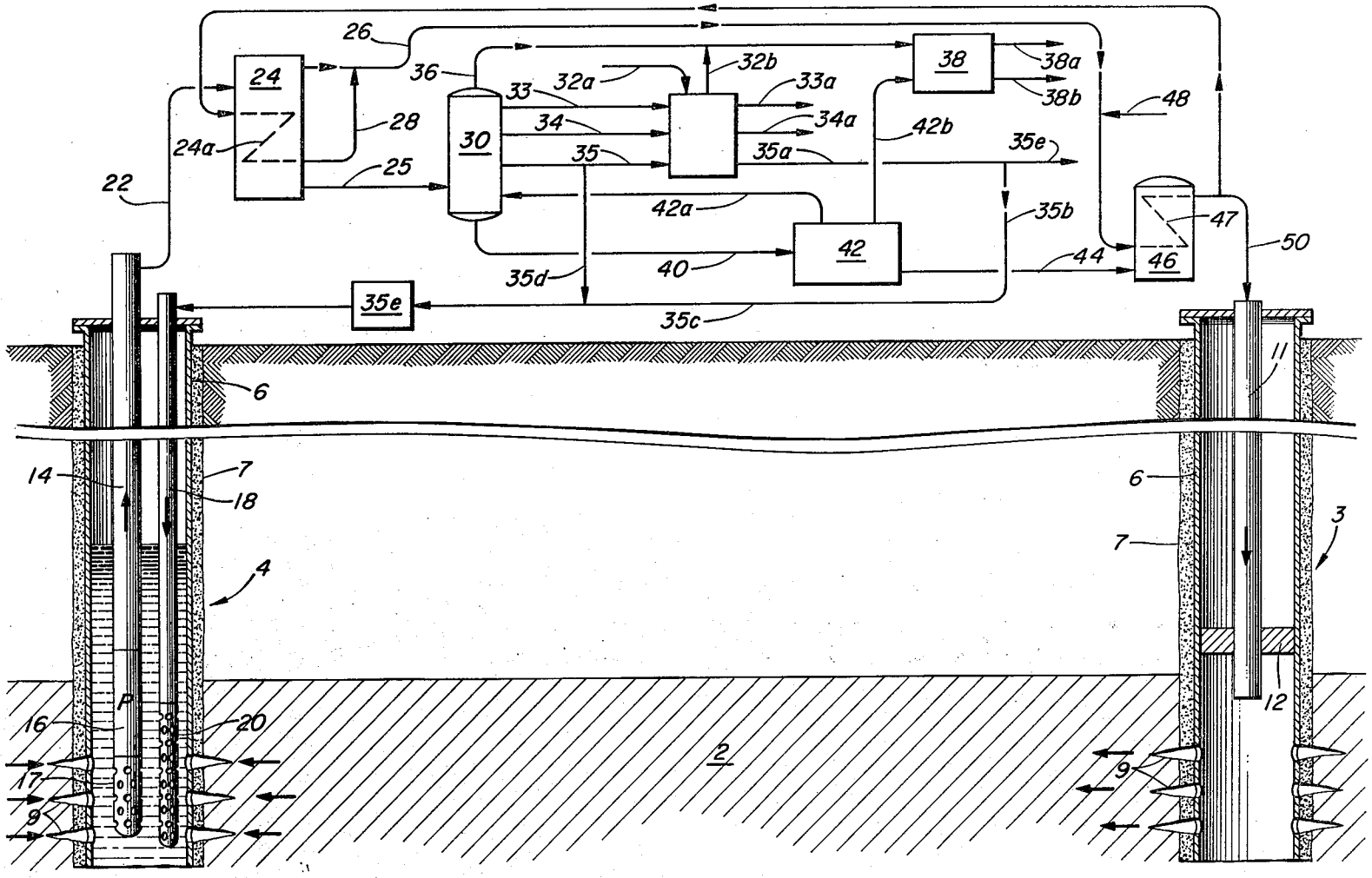
3
50
11
12
47
46
48
6
7
9
44
38a
38b
35e
35b
38
42b
42
33a
34a
35a
32b
2
42a
40
35c
32a
34
35
33
35d
30
36
28
25
26
35e
24
24a
22
6
7
18
4
20
14
16
17
9

THERMAL OIL RECOVERY WITH SOLVENT RECIRCULATION

DESCRIPTION

1. Technical Field

This invention relates to the recovery of oil from subterranean oil reservoirs and more particularly to thermal recovery processes involving the injection of a hot aqueous fluid into the reservoir coupled with the recirculation of a diluent solvent in one or more production wells to facilitate the production of oil from such wells.

2. Background of Invention

In the recovery of oil from oil-bearing reservoirs, it usually is possible to recover only minor portions of the oil in place by the so-called primary recovery techniques which utilize only the natural forces present in the reservoir. Thus, a variety of supplemental recovery processes have been employed in order to increase the recovery of oil from subterranean reservoirs. In some cases, the supplemental recovery techniques are employed after primary production and in others they are used to increase or obtain production initially. For example, certain of the so-called "heavy oil" reservoirs such as tar sands and the like are not productive in their original state and require the initial application of supplemental recovery techniques.

In supplemental recovery techniques, energy is supplied to the reservoir in order to facilitate the movement of fluids within the reservoir to a production system comprised of one or more production wells through which the fluids are withdrawn to the surface of the earth. Thus, a fluid such as water, gas or a miscible fluid; e.g., hydrocarbon solvent, may be injected into the reservoir through an injection system comprised of one or more wells. As the fluid is moved through the reservoir, it acts to displace the oil therein to the production well or wells.

One technique which is sometimes applied to the recovery of relatively viscous reservoir oils is miscible flooding which involves the injection of an oil-miscible liquid followed by a suitable driving fluid. For example, U.S. Pat. No. 2,412,765 to Buddrus et al. discloses the injection of a hydrocarbon slug comprising a mixture of propane and butane into the reservoir in order to displace the oil therein to a production well. The accumulated hydrocarbon solvent containing reservoir oil is recovered from the production well and then subjected to a fractionation procedure where a recycle fraction comprising essentially propane and butane is obtained. The recycle fraction is then reinjected into the reservoir via the input well in a continuation of the process.

Other supplemental oil-recovery techniques involve the application of heat to the reservoir. These procedures, commonly termed thermal recovery, are particularly useful in the recovery of thick, heavy oils such as viscous petroleum crude oils and the heavy tar-like hydrocarbons present in tar sands. While these tar-like hydrocarbons may exist within the reservoir in a solid or semisolid state, they undergo a pronounced decrease in viscosity upon heating such that they behave somewhat like the more conventional petroleum crude oils. Thermal recovery procedures may involve in situ combustion techniques or the injection of hot fluids either for the purpose of displacing the oil in the reservoir or for the purpose of heating the oil by conduction and/or convection or by a combination of these processes.

Typically, where a hot fluid is injected into the reservoir, it will take the form of an aqueous fluid; i.e., steam or hot water.

One useful thermal recovery process involving the injection of a hot aqueous fluid is disclosed in U.S. Pat. No. 4,265,310 to Britton et al. In this procedure, which is particularly applicable to the recovery of heavy, viscous tars, the oil reservoir is initially fractured between injection and production wells and a hot aqueous liquid is injected into the reservoir via the production and injection wells to "float the fracture zone" and heat the adjacent reservoir oil (tar). The continued injection of hot aqueous fluid through the injection wells facilitates the flow of fluid from the reservoir into the production well or wells. In addition, a diluent solvent is injected down the production well to the producing horizon where it is admixed with the heavy oil within the well. This prevents plugging of the production well by congealing of the heavy oil and facilitates lifting of the oil to the surface of the earth. The thinning agent may take the form of a light crude oil or crude oil fraction such as kerosene distillate and may be injected down the tubing-casing annulus of the production well or through a parallel tubing string next to the production tubing string. Where the well is equipped with a sucker-rod pumping system, the thinning agent may be injected down hollow sucker rods or through the rod-tubing annulus.

SUMMARY OF THE INVENTION

In accordance with the invention, there is provided a new and improved process for the recovery of oil from a subterranean oil reservoir by the injection of a hot aqueous fluid into the reservoir coupled with the recirculation of a diluent solvent to the production well. The invention is carried out in the subterranean oil reservoir which is penetrated by one or more production wells and which contains oil having a density greater than the density of water. A hot aqueous fluid is injected into the reservoir in order to heat the reservoir oil, thus reducing its viscosity and facilitating the flow of oil from the reservoir into the production well. A diluent solvent is circulated down the well in order to produce a blend of oil and solvent which is produced to the surface of the well along with water which accumulates in the well. In practicing the present invention, the diluent solvent circulated down the well has a density such that the density of the resulting blend is greater than the density of the water produced from the well along with the blend. At the surface, the water is separated from the blend and this mixture is then treated in order to recover a solvent fraction having a density as described above. The solvent fraction is then recycled to the production well for circulation down the well in a continuation of the process.

Preferably the gravity differential between the blend of oil and solvent and the water is equal to or greater than an increment of 5° API. Thus, assuming that the water has an API gravity of 10 (specific gravity of 1), the blend would exhibit an API gravity of 5 or less. It is also preferred that the density of the solvent itself be greater than the density of the water and that the gravity differential between the solvent and the water be an increment of at least 5° API.

BRIEF DESCRIPTION OF THE DRAWINGS

The drawing is a schematic illustration partly in section showing spaced injection and production wells penetrating an oil reservoir and an associated surface treating facility which may be employed in carrying out the present invention.

BEST MODES OF CARRYING OUT THE INVENTION

In the recovery of heavy oil by the injection of steam and/or hot water, various techniques and well combinations may be employed in introducing the hot aqueous fluid into the reservoir and in withdrawing the heated oil from the reservoir. One well-known format employs the displacement of fluids between separate injection and production systems which comprise one or more wells extending from the surface of the earth into the subterranean reservoir. The injection and production wells may be located and spaced from one another in any desired pattern. For example, an inverted five-spot pattern of the type disclosed in the aforementioned patent to Britton et al. may be employed. Other patterns which may be used include line-drive patterns involving a plurality of injection wells and production wells arranged in rows; and circular drive patterns such as seven-spot and nine-spot patterns which, like the inverted five-spot pattern referred to previously, comprise a central injection well and surrounding production wells.

The well system for the production and withdrawal of fluids may also be provided by one or more dually completed injection-production wells of the type disclosed; for example, in U.S. Pat. No. 2,725,106 to Spearow. This arrangement may sometimes be utilized to advantage in relatively thick reservoirs where it is desired to displace the oil in a more or less vertical direction through the reservoir. For example, the injection system may comprise an upper completion interval of one or more multiply completed wells of the type described in the aforementioned patent to Spearow and the production system a lower completion interval of such wells. In this case, steam or hot water is injected through the upper completion intervals in order to displace the oil downwardly through the reservoir where it is recovered from the lower completion intervals.

Another technique for injecting a hot aqueous fluid into a subterranean formation involves the so-called "huff and puff" procedure in which the same well is employed alternatively for injection and production. In this case, the hot aqueous fluid, usually steam, is injected into the well and into the surrounding reservoir and the well then closed for a period of time. During this time, the so-called "soak period," heat transfer between the injected steam and the reservoir oil takes place with an attendant reduction in viscosity of the oil. Thereafter, the well is placed on production and the heated, lower viscosity oil flows from the reservoir into the well. As oil production falls off, the above cycle of operations is then repeated.

Regardless of the well system and injection-production format employed, a number of problems are involved in the thermal recovery of heavy oil by the injection of hot water or steam into the reservoir. In many cases, the crude oil, although reduced considerably in viscosity by the thermal technique, is still difficult to produce from the bottom of the well to the surface. The lifting difficulties encountered are exacerbated where the oil undergoes some cooling in the course of flowing upwardly to the surface. This usually occurs where separate wells are employed for the injection and production of fluids as disclosed; for example, in the aforementioned patent to Britton et al. In this case, the well is not heated by hot fluid injection, or is heated only initially, as contrasted with the use of dually completed wells or the "huff and puff" technique as described above.

The recovery of the heated oil is also accompanied by the flow of water into the production well. The produced water includes cooled injection water or condensate from the injected steam and may also include connate water from the reservoir. The oil and water mixture may take the form of an emulsion which is difficult to break because of the relatively high viscosity of the oil.

In the practice of the present invention, the lifting and handling problems associated with thermal oil recovery by aqueous fluid injection are alleviated by circulating to the production well a diluent solvent which is recovered as a fraction from the produced oil stream and which, while relatively low in viscosity, is of a relatively high density such that the density of the resulting oil-solvent blend produced from the well is greater than the density of the accompanying water. This procedure offers a number of advantages over the use of a light solvent, such as disclosed in Britton et al., and also may be contrasted with the procedure disclosed in Buddrus et al. in which the light distillate fraction recovered from the production stream is employed in displacing oil from the formation rather than in circulation down the production well. The present invention may be applied in the recovery of any heavy oil having a density greater than the density of water. The term "oil" as used herein is meant to include viscous, semisolid, or solid hydrocarbonaceous material which is rendered less viscous by heating and thus includes viscous petroleum oils and bituminous tars such as found in tar sands and the like.

The diluent solvent may be recovered from the production stream by any suitable fractionation procedure provided that it meets the desired viscosity and density characteristics. A preferred diluent solvent is a gas oil cut produced by fractional distillation of the produced crude oil as described in great detail hereinafter. The gas oil cut, or other fraction as the case may be, is compatible with the crude oil since it is derived from the same source material. Thus, precipitation problems which might otherwise be encountered in forming a downhole blend are avoided. Oil-water separation treatment at the surface is facilitated by employing the solvent of a density such that the resulting blend of oil and solvent remains heavier than water. This results in an inverted phase separation; i.e., oil on the bottom and water on the top, throughout the production process regardless of the relative amounts of crude oil and solvent in the production stream at any given time. The inverted phase separation also offers the advantage that any heaters required to maintain the oil viscosity at the desired level can be located in the bottom of the treater vessels. In addition, any precipitates which form will settle to the bottom for withdrawal with the oil stream, thus resulting in a cleaner water stream. The gas oil cut, as described hereinafter, has a relatively low volatility such that circulation and handling losses are minimized. It is also normally less expensive than the lighter cuts. Thus, any losses which are sustained are less costly.

Turning now to the drawing, there is illustrated a heavy oil reservoir 2 which is penetrated by spaced injection and production wells 3 and 4, respectively. While, for the purpose of simplicity in describing the invention, only one injection well and one production well are shown, it will be recognized that in practical applications of the invention a plurality of such wells may be utilized. For example, injection well 3 may be considered to be the central well in an inverted five-spot pattern of the type disclosed in the aforementioned patent to Britton et al and the production well 4 one of the corner wells. Each of the wells 3 and 4 is provided with a casing string 6 which is set into the oil reservoir and cemented as indicated by reference numeral 7. The casing string and surrounded cement sheaths are perforated, as indicated by reference numerals 9, opposite the producing horizon 2. Of course, various other procedures, such as use of a slotted liner or an open hole completion, are well known in the art and may be employed to provide for the flow of fluids between the wells and the surrounding formation.

The injection well 3 is equipped with a tubing string 11 which extends from the surface of the well through a packer 12 to a suitable depth, for example, adjacent the formation 2 as shown. The production well 4 is equipped with a production string 14 which extends from the surface to a suitable depth within the well, normally to or below the oil reservoir 2. Liquid from the oil reservoir 2 accumulates in the annulus between tubing 14 and casing 6 and is produced to the surface through the interior of tubing string 14 by means of a pump 16 at the lower end thereof. Pump 16 may be of any suitable type but normally will take the form of a conventional sucker-rod pumping system in which a travelling valve and plunger assembly is reciprocated by a surface pumping unit (not shown). The fluid in the tubing-casing annulus enters the pump through any suitable means such as a perforated anchor sub indicated by reference numeral 17. In some cases the well may be operated as a flowing well. For example, the injection of hot aqueous fluid into the formation may result in a bottom hole pressure which is greater than the head of liquid within the well. In this case, the well pumping system may be dispensed with.

The production well 4 is also provided with a second tubing string 18 which is run in the tubing-casing annulus parallel to the production string. Tubing string 18 is employed for the injection of diluent solvent, as described hereinafter, and preferably is landed adjacent to or below the inlet to production string 14. In the well completion scheme illustrated, a section of the tubing string 18 is perforated as indicated by reference numeral 20 to provide for the introduction of the diluent into the standing oil column throughout a significant interval thereof.

As noted previously, the crude oil within reservoir 2 has a density greater than the density of water. The solvent circulated down the tubing string 18 has a density such that the density of the blend of oil and solvent produced within the well remains greater than the density of the water. The production stream from tubing 14 is supplied via a gathering line 22 to suitable dehydration means such as a heater-treater 24. In the heater-treater, steam is passed through heat-exchange coils **24*a* in order to provide heat for deemulsification and to reduce the oil viscosity to a suitable level. Since the blend is heavier than water, it is withdrawn from the heater-treater near the lower end thereof via line 25. The lighter water is withdrawn from the heater near the top via line 26. Condensate from the heat-exchange coils is also returned to water line 26 by means of condensate line 28. The blend is then processed in a fractionator of any suitable type to recover a solvent fraction suitable for recirculation to the production well. In the embodiment illustrated, the blend is supplied to a fractional distillation column 30 which is operated to produce a naphtha cut, a distillate fraction, and a gas oil fraction, which are supplied to a desulfurization unit 32 by means of lines 33, 34 and 35 respectively. The top vapor fraction from the distillation column is supplied via line 36 to a sulfur plant 38**.

Desulfurization unit 32 may be of any suitable type. For example, molecular hydrogen may be supplied via line **32*a* in order to reduce organic sulfur in the several fractions from the distillation unit. The hydrogen sulfide thus evolved is supplied via line 32*b* to the overheads fraction from the distillation column. The streams 33, 34 and 35 may be desulfurized separately or mixed. The stream 35 may or may not be hydrogen treated before drawing off the recycle diluent. Thus the gas oil fraction is withdrawn from the desulfurization unit by means of line 35*a* and a portion of it may be passed via line 35*b* to line 35*c*. Alternatively, the gas oil fraction may be passed via line 35*d* to line 35*c*. In either case, the desired amount of gas oil is recycled through line 35*c* and surge tank 35*e* to the production well. The solvent is then injected down tubing string 18** to form a blend of oil and solvent as described previously.

A portion of the effluent from the fractionation procedure may be employed in the derivation of fuel used in the generation of steam for injection down well 3. Thus, in the embodiment illustrated, the residual bottoms fraction from the distillation column is passed through line 40 to a coking unit 42 which produces petroleum coke in a suitable calcined, desulfurized form for use as boiler fuel. The output from the coking unit 42 is supplied via line 44 to a boiler 46. Water from the surface treating facility is applied via line 26 to the steam coils 47 within the boiler. Such makeup water as is necessary is added to the boiler feed water through line 48. The steam from boiler 46 is supplied by line 50 to the injection tubing 11 in well 3.

Vapor from coking unit 42 is circulated by means of line **42*a* to the distillation unit 30. Calciner gas from the coking unit is withdrawn through line 42*b* and fed to the sulfur plant 38**.

Coking unit 42 may be of any suitable type, preferably one which produces coke satisfactory for use as a boiler fuel. One suitable process for the production of petroleum coke is a delayed coker as disclosed in U.S. Pat. No. 3,116,231 to Adee. The residual bottoms fractions from heavy tar-like oils often contain relatively large amounts of sulfur and other impurities and, if necessary, special procedures for the desulfurization and calcination of the coke may be incorporated into the coking procedure. For example, the green coke may be calcined in an internally-fired vertical shaft kiln of the type disclosed in U.S. Pat. No. 4,251,323 to Smith. High-sulfur coke may also be treated by a two-stage thermal desulfurization process as disclosed in U.S. Pat. No. 4,160,814 to Hardin et al. Other known coking processes which may be used include fluidized bed coking and formcoking.

As indicated previously, the sour gas effluents from the distillation column 30, the desulfurization unit 32, and the coking unit 42 are supplied via lines 36, **32*b***, and 42*b*, respectively, to the sulfur plant 38. Sulfur plant 38 may be of any suitable type but usually will take the form of a conversion plant in which the hydrogen sulfide is oxidized with the attendant deposition of elemental sulfur. Sweet gas may be withdrawn from the unit 38 via line 38*a* and elemental sulfur from the unit via line 38*b*.

As described previously, the density of the solvent injected down tubing 18 is such that, when the solvent is mixed with the crude oil in the proportions necessary to arrive at the desired viscosity for production, the resulting blend has a density greater than the density of the produced water. Preferably, the diluent solvent itself also has a density greater than the density of the water. This enables the surface treating facility to accommodate variable production rates, as well as variable solvent injection rates, without the reversal of phases in the oil-water separation facility. The density of oil may be expressed in a number of ways. The most common scale is the API scale which is related to specific gravity as follows:

$$\text{Degrees API} = \frac{141.5}{\text{specific gravity}} - 131.5$$

Preferably, the density of the blend of oil and solvent is greater than the density of the water by an increment of at least 5° API. It is also preferred that the density of the solvent itself be greater than the density of the water by an increment of at least 5° API.

The heavy oils subject to recovery by the present invention are often highly viscous even at the elevated temperatures normally encountered during operation of the oil-water separator. For example, conventional heater treaters are typically operated at temperatures of about 180°–210° F. Within this temperature range, the heavy oil may still exhibit a viscosity of several thousand centipoises. In order to facilitate the separation of oil and water at the surface, it is preferred in carrying out the invention to employ the solvent in relative proportions to provide a blend of solvent and oil which has a viscosity of 300 centipoises or less at the temperature at which the water separation step is carried out. Where feasible, it will be preferred to provide a blend having a viscosity no greater than 100 centipoises at the treater temperature.

The injection rate of diluent solvent relative to the oil production rate may vary depending upon the oil and the solvent viscosities and, in some cases, the densities. Usually it will be desirable to provide a ratio of solvent to oil in the blend of no greater than 1; i.e., equal parts oil and diluent in the blend. A preferred range for the ratio of solvent to oil in the blend is from 0.3 to 1.0 parts solvent to one part oil.

A specific example of the present invention may be found in its application to recover a heavy South Texas crude oil of the type referred to in the aforementioned patent to Britton et al. By way of example, the crude oil may have a density of −1.5° API and a viscosity at 210° F. of 5845 centipoises. The crude oil contains sulfur in a concentration of 10.28 percent by weight and contains 26 percent by weight Conradson carbon. The diluent solvent is a coker gas oil cut, recovered via line 35 from the fractional distillation column, having an initial boiling point of 625° F. and a final boiling point of 875° F. This fraction has a gravity of 4.5° API and a viscosity at 180° F. of 2.5 centipoises. The sulfur concentration of the coker gas oil cut, prior to the desulfurization step, is 7.5 weight percent. By injecting the gas oil at a rate sufficient to provide an oil solvent blend of equal parts oil and solvent, the resulting blend has a gravity of about 1.4° API. The viscosity of this blend is about 100 centipoises at 100° F. and about 7.5 centipoises at 200° F. The material balance for this process, assuming a basis of 100 pounds of heavy oil, is set forth in the table.

In the table, the various streams in the material balance are identified by the reference numerals used in the drawing. For example, the fractionator feed is identified by reference to numeral 25 in the drawing, the sweet gas effluent from the sulfur plant by numeral 32*a*, etc.

TABLE

| | Feed 25 | Gas 38a | Sulfur 38b | Naphtha 33a | Gas Oil 34a | Vapor 35a | Feed 42a | Coker Gas Oil 40 | Recycle Gas Oil 35d | Net Gas 35e | Calciner Coke 42b | 44 |
|---|---|---|---|---|---|---|---|---|---|---|---|---|
| Crude Oil | 100 | | | | | | | | | | | |
| Gas or Vapor | | 8 | | | | | 69 | | | | 4 | |
| Naphtha | | | | 15 | | | | | | | | |
| Distillate | | | | | 21 | | | | | | | |
| Gas Oils/ Solvent | 100 | | | | | 120 | | | 100 | 20 | | |
| Resid | | | | | | | | 100 | | | | |
| Sulfur | | | 9 | | | | | | | | | |
| Coke | | | | | | | | | | | | 27 |
| Totals | 200 | 8 | 9 | 15 | 21 | 120 | 69 | 100 | 100 | 20 | 4 | 27 |
| Approx. % S | 5.0 | 0 | 100 | .003 | .04 | 0.5 | 9.5 | 11.0 | 0.5 | 0.5 | 91 | 1.5 |

The use of a gas oil fraction from the produced oil is particularly advantageous in carrying out the present invention since it provides a diluent solvent of the requisite high density, but still has a low viscosity. Also, since it is derived from the produced crude oil, it is expected to be compatible with the crude oil and to more easily dissolve in it than a solvent from another source. The use of a low viscosity diluent is desirable not only from the standpoint of arriving at the desired blend viscosity but also to provide for efficient mixing of the solvent with the heavy oil at the downhole location within the production well. In this regard, it is preferred to employ a diluent solvent having a viscosity, at the temperature at which it is injected into the heavy oil, of 5 centipoises or less. As indicated above, the coker gas-oil cut is well suited to this end.

Having described specific embodiments of the present invention, it will be understood that modifications thereof may be suggested to those skilled in the art, and it is intended to cover all such modifications as fall within the scope of the appended claims.

What is claimed is:

1. In a method for the recovery of oil from a subterranean reservoir containing oil therein having a density greater than the density of water and penetrated by a production well, wherein a hot aqueous fluid is injected into said reservoir to reduce the viscosity of oil within said reservoir to facilitate the flow of oil into said well and a diluent solvent is circulated down said well to produce a solvent-oil blend of decreased viscosity which is produced from said well in admixture with water, the improvement comprising:

(a) employing a diluent having a density such that the density of the resulting oil-solvent blend is greater than the density of the water produced from said well along with said blend, (b) separating said water from said oil-solvent blend, (c) fractionating the oil-solvent blend to recover a solvent fraction having a density as set forth in step (a), and (d) circulating said solvent fraction down said production well in accordance with step (a).

2. The method of claim 1 wherein the viscosity of said solvent-oil blend at the temperature at which said water separation step is carried out is no greater than 300 cps.

3. The method of claim 1 wherein the viscosity of said solvent-oil blend at the temperature at which said water separation step is carried out is no greater than 100 cps.

4. The method of claim 1 wherein said solvent has a density which is greater than the density of said water.

5. The method of claim 1 wherein the density of said oil-solvent blend is greater than the density of said water by an increment of at least 5° API.

6. The method of claim 5 wherein the density of said solvent is greater than the density of said water by an increment of at least 5° API.

7. The method of claim 1 wherein said solvent is circulated down said production well at a rate to provide a ratio of solvent to oil in said blend of no greater than 1.

8. The method of claim 7 wherein said solvent is circulated down said production well at a rate to provide a ratio of solvent to oil in said blend within the range of 0.3 to 1.0.

9. The method of claim 1 wherein said hot aqueous fluid is steam and further comprising the step of generating said steam by the combustion of a fuel derived from the fractionation of said oil-solvent blend.

10. The method of claim 1 wherein said blend is fractionated by fractional distillation and said solvent fraction is a gas-oil cut having a viscosity at the temperature circulated down said production well of no greater than 5 centipoises.

* * * * *